US010705452B2

(12) United States Patent
Shigehiro

(10) Patent No.: US 10,705,452 B2
(45) Date of Patent: Jul. 7, 2020

(54) DEVELOPING DEVICE HAVING MAGNETIC FLUX DENSITY DISTRIBUTION

(71) Applicant: CANON KABUSHIKI KAISHA, Tokyo (JP)

(72) Inventor: Koji Shigehiro, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/394,334

(22) Filed: Apr. 25, 2019

(65) Prior Publication Data

US 2019/0250531 A1 Aug. 15, 2019

Related U.S. Application Data

(63) Continuation of application No. PCT/JP2017/039844, filed on Oct. 27, 2017.

(30) Foreign Application Priority Data

Oct. 28, 2016 (JP) ..... 2016-212084

(51) Int. Cl.
*G03G 15/08* (2006.01)
*G03G 15/09* (2006.01)

(52) U.S. Cl.
CPC ..... *G03G 15/0812* (2013.01); *G03G 15/0921* (2013.01)

(58) Field of Classification Search
CPC ..... G03G 15/0812; G03G 15/0921
See application file for complete search history.

(56) References Cited

U.S. PATENT DOCUMENTS 4,492,456 A * 1/1985 Haneda ..... G03G 15/09 399/275
5,072,690 A * 12/1991 Ishikawa ..... G03G 15/09 399/275

(Continued)

FOREIGN PATENT DOCUMENTS

JP H04-350875 A 12/1992
JP 2000-338783 A 12/2000

(Continued)

OTHER PUBLICATIONS

PCT International Search Report and Written Opinion dated Jan. 9, 2018, in PCT/JP2017/039844.

*Primary Examiner* — G. M. A Hyder
(74) *Attorney, Agent, or Firm* — Venable LLP

(57) ABSTRACT

A developing device includes a rotatable developer carrying member, a developer regulating member, and a cylindrical magnetic field generating member provided inside the developer carrying member and including a regulating magnetic pole provided opposed to the developer regulating member. A magnetic flux distribution provided by the regulating magnetic pole includes a first local maximum portion on a side upstream of a closest position between the magnetic field generating member and the developer regulating member, a second local maximum portion on a side downstream of the closest position, and a local minimum portion between the first local maximum portion and the second local maximum portion. A rectilinear line connecting the closest position and a center of the magnetic field generating member is positioned between the first local maximum portion and the second local maximum portion.

4 Claims, 9 Drawing Sheets

(56) References Cited

U.S. PATENT DOCUMENTS

| | | | | |
|---|---|---|---|---|
| 5,446,526 | A * | 8/1995 | Shimizu | B82Y 15/00 399/274 |
| 7,885,583 | B2 | 2/2011 | Shigehiro | |
| 7,957,681 | B2 | 6/2011 | Shigehiro | |
| 8,014,705 | B2 | 9/2011 | Matsumoto et al. | |
| 9,213,259 | B2 | 12/2015 | Shigehiro | |
| 10,007,212 | B2 | 6/2018 | Shigehiro | |
| 10,261,442 | B2 | 4/2019 | Shigehiro | |
| 10,274,880 | B2 | 4/2019 | Shigehiro | |
| 2004/0265014 | A1* | 12/2004 | Takeuchi | G03G 15/0921 399/274 |
| 2006/0013622 | A1* | 1/2006 | Lee | G03G 15/0921 399/274 |
| 2008/0181676 | A1* | 7/2008 | Yamagishi | G03G 15/0812 399/275 |
| 2012/0243911 | A1* | 9/2012 | Iwamura | G03G 15/0921 399/254 |
| 2015/0220017 | A1* | 8/2015 | Shigehiro | G03G 15/0818 399/276 |

FOREIGN PATENT DOCUMENTS

| | | | |
|---|---|---|---|
| JP | 2001-272862 | A | 10/2001 |
| JP | 2008-275719 | A | 11/2008 |
| JP | 2015-145994 | A | 8/2015 |

* cited by examiner

DEVELOPING DEVICE HAVING MAGNETIC FLUX DENSITY DISTRIBUTION

This application is a continuation of PCT Application No. PCT/JP2017/039844, filed on Oct. 27, 2017.

TECHNICAL FIELD

The present invention relates to a developing device for use with an image forming apparatus of an electrophotographic type, an electrostatic recording type, or the like.

BACKGROUND ART

A conventional image forming apparatus of the electrophotographic type has been widely used as a copying machine, a printer, a plotter, a facsimile machine, a multifunction machine having a plurality of functions of these machines, and the like. In the image forming apparatus of this type, toner charged in a developing device is brought near to a photosensitive drum which is an example of an image bearing member and is electrostatically deposited on an electrostatic latent image on the photosensitive drum, and thus development is carried out, so that an image is formed. In order to develop the electrostatic latent image, the developing device is incorporated in the image forming apparatus. In the developing device, at a position of a developer container (developing container) opposing the photosensitive drum, a developing sleeve as a developer carrying member is rotatably provided. The developing sleeve incorporates a magnet roller as a magnetic flux generating means. As a developer, a two-component developer containing non-magnetic toner and a magnetic carrier is used.

For development, the developer is partly regulated by a developer regulating member through rotation of the developing sleeve and passes through between the developing sleeve and the developer regulating member, so that the developer is coated in a thin layer on a developing sleeve surface and then is fed to a developing region opposing the photosensitive drum. In the developing region, the developer forms a chain-like magnetic chain by a magnetic flux generated by the magnet roller. This magnetic chain is in proximity to or in contact with the photosensitive drum, and only the toner is transferred onto the electrostatic latent image formed on the surface of the photosensitive drum by a developing bias applied to the developing sleeve, so that a toner image corresponding to the electrostatic latent image is formed on the surface of the photosensitive drum.

Here, an amount of the developer supplied to a developing nip which is the developing region between the developing sleeve and the photosensitive drum is determined by a gap (interval) between the developing sleeve surface and the developer regulating member (hereinafter referred to as an SB gap).

Conventionally, as the developer regulating member constituting the SB gap by a simple constitution, a developer regulating member which has a cylindrical shape and which has a magnetic property has been developed (Japanese Laid-Open Patent Application (JP-A) 2008-275719). In the developing device including this developer regulating member, the magnet roller has a plurality of magnetic poles containing a developing (magnetic) pole opposing the photosensitive drum and a regulating magnetic pole opposing the developer regulating member. This magnet roller is magnetized so as to have a single (one) maximum value in a magnetic flux density distribution of the regulating magnetic pole.

In general, an application amount of the developer coated in the thin layer on the developing sleeve is controlled (managed) by M/S which is a developer weight per unit area. In the developing device including this developer regulating member, during assembling, a position of the maximum value in the magnetic flux density distribution of the regulating magnetic pole is appropriately adjusted and set at a side upstream or downstream of the SB gap, so that stabilization of M/S is realized.

Problem to be Solved by the Invention

Incidentally, a value of the SB gap is fluctuated in some cases by a tolerance of component parts of the developing device and a tolerance during assembling. For that reason, the developing device is required for realizing a high image quality and development with the high image quality that a range in which the value of M/S fluctuates is minimized even in the case where a width of the SB gap fluctuates.

However, in the above-described developing device of JP-A 2008-275719, the magnetic flux density distribution of the regulating magnetic pole has the single maximum value, and therefore, in the case where the value of the SB gap is fluctuated by the tolerance of component parts of the developing device and the tolerance during assembly, there is a possibility that the value of M/S largely fluctuates. That is, when the maximum value of the magnetic flux density distribution is one, the magnetic flux density of the maximum value extremely concentrates by the influence of magnetic flux extending toward the developer regulating member having the magnetic property and thus largely changes. For this reason, when an amount of a change in magnetic flux density by a minute positional difference on an upstream side or a downstream side in the SB gap and thus the maximum value is deviated from a designed position by various tolerances, a fluctuation in a change of a passing amount of the developer becomes large, so that M/S becomes unstable in some instances.

The present invention aims at providing a developing device capable of realizing stabilization of a developer weight per unit area of a developing sleeve even when an SB gap is fluctuated by a tolerance of component parts and a tolerance during assembly.

Means for Solving the Problem

A developing device of the present invention includes: a cylindrical developing sleeve for carrying and rotationally feeding a developer including non-magnetic toner and a magnetic carrier; a developer regulating member which is provided opposed to developing sleeve, which has a magnetic property and which is curved in a direction of projecting toward the developing sleeve, for regulating an amount of a developer carried on the developing sleeve with respect to a rotational direction of the developing sleeve and includes a magnetic flux generating means which is provided inside the developing sleeve and which has a plurality of magnetic poles including a regulating magnetic pole provided opposed to the developer regulating member, and a magnetic flux density distribution of a regulating magnetic pole includes a first local maximum portion on a side upstream, with respect to the rotational direction, of a closest position on the magnetic flux generating means to the developer regulating member, a second local maximum portion on a side downstream of the closest position with respect to the rotational direction, and a local minimum portion at a position between the first local maximum portion and the second local maximum portion.

Effect of the Invention

According to the present invention, even when an SB gap is fluctuated by a tolerance of component parts and a tolerance during assembly stabilization of a developer weight per unit area of a developing sleeve can be realized.

EMBODIMENTS FOR CARRYING OUT THE INVENTION

In the following, a developing device in an embodiment of the present invention will be specifically described with reference to FIGS. 1 to 6. In this embodiment, the case where the developing device is applied to, as an example of an image forming apparatus, a full-color printer of a tandem type is described. However, the developing device of the present invention is not limited to the developing device of the image forming apparatus of the tandem type but may also be a developing device of an image forming apparatus of another type. Further, the developing device is not limited to the developing device for a full-color image, but may also be a developing device for a monochromatic image or a developing device for a mono-color (single color) image. Or, the developing device can be carried out in various uses, such as printers, various printing machines, copying machines, facsimile machines and multi-function machines by adding necessary devices, equipment and casing structures or the like. Further, in this embodiment, an image forming apparatus 1 is of a type in which an intermediary transfer belt 44*b* is provided and toner images of respective colors are primary-transferred from photosensitive drums 81 onto the intermediary transfer belt 44*b* and thereafter composite toner images of the respective colors are secondary-transferred altogether onto a sheet S. However, the image forming apparatus is not limited thereto, but may also employ a type in which a toner image is directly transferred from a photosensitive drum onto a sheet fed by a sheet feeding belt.

Further, in this embodiment, as a developer, a two-component developer which is mixture of non-magnetic toner and a magnetic carrier is used. The toner is formed by incorporating a colorant, a wax component and the like in a resin material such as polyester or styrene through pulverization or polymerization. The carrier is formed by subjecting a surface layer of a core consisting of resin particles, with which ferrite particles or magnetic powder is kneaded, to resin coating.

Figure 1:
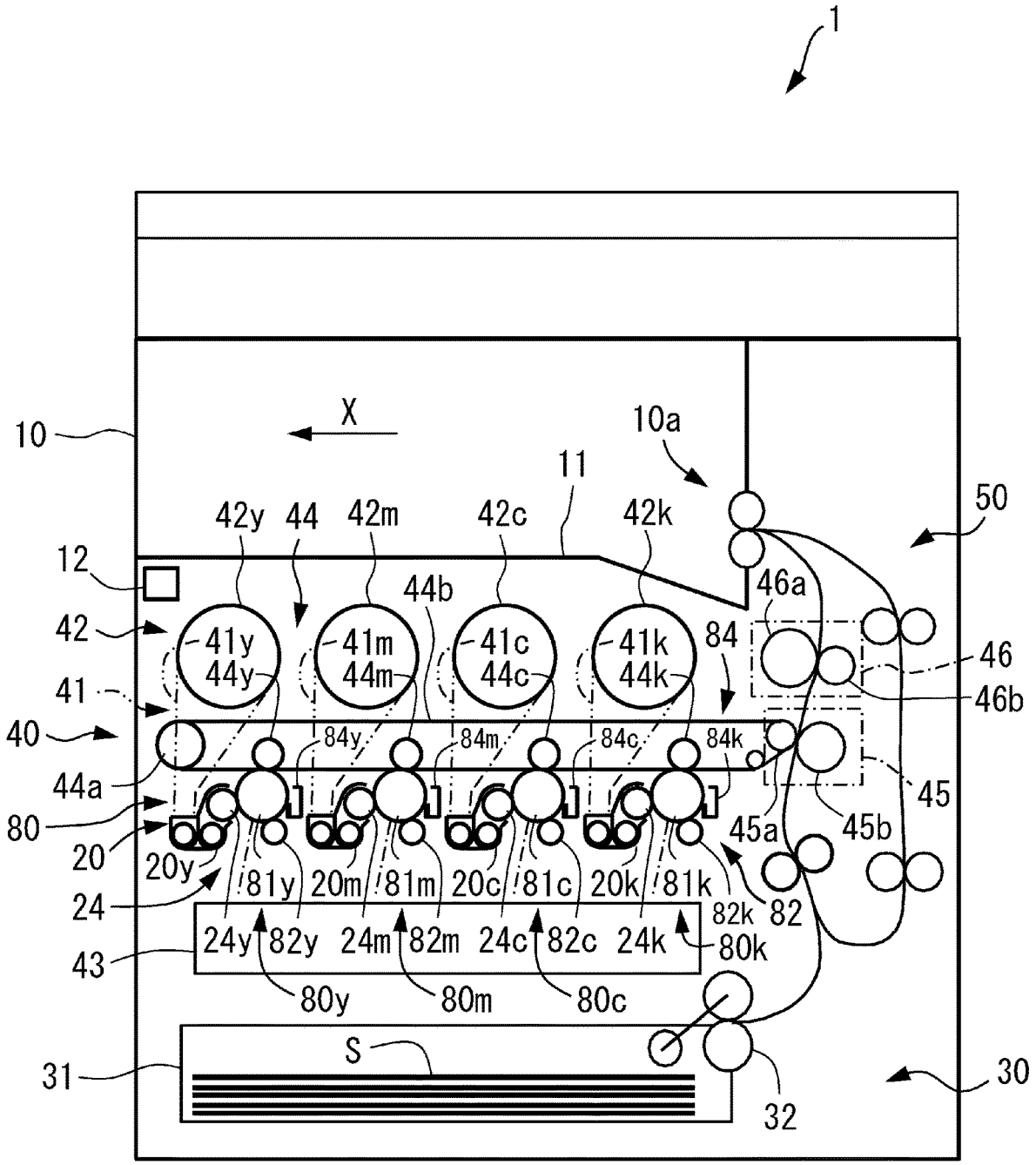
FIG. 1 is a sectional view showing a schematic structure of an image forming apparatus according to an embodiment.

As shown in FIG. 1, the image forming apparatus 1 includes an image forming apparatus main assembly (hereinafter, referred to as an apparatus main assembly) 10 as a casing. The apparatus main assembly 10 includes, a sheet feeding portion 30, an image forming portion 40, a sheet feeding (conveying) portion 50, a sheet discharge portion 11, and a controller 12. On the sheet S as a recording material, the toner image is to be formed, and specific examples of the sheet S may include plain paper, a resin-made material sheet as a substitute for the plain paper, thick paper, a sheet for an overhead projector, and the like.

The sheet feeding portion 30 is disposed at a lower portion of the apparatus main assembly 10, and includes a sheet cassette 31 for stacking and accommodating the sheets S such as recording paper and includes a feeding roller 32, and feeds the accommodated sheet S to the image forming portion 40.

The image forming portion 40 includes image forming units 80, toner bottles 41, toner containers 42, a laser scanner 43, an intermediary transfer unit, a secondary transfer portion 45 and a fixing device 46. The image forming portion 40 is capable of forming an image on the sheet S on the basis of image information. Incidentally, the image forming apparatus 1 in this embodiment meets full-color image formation, and the image forming units 80*y*, 80*m*, 80*c*, 80*k* have similar constitutions for four colors of yellow (y), magenta (m), cyan (c), black (k), respectively, and are separately provided. Also the toner bottles 41*y*, 41*m*, 41*c*, 41*k* and the toner containers 42*y*, 42*m*, 42*c*, 42*k* similarly have the same constitution for the four colors of yellow (y), magenta (m), cyan (c), black (k), respectively, and are separately provided. For this reason, in FIG. 1, respective constituent elements for the four colors are represented by identifiers for the colors, but in FIG. 2 and in the specification, are described using only reference numerals or symbols without adding the identifiers for the colors in some cases.

The toner containers 42 are, for example, cylindrical bottles, and the toners are accommodated, and above the respective image forming unit 80, the toner container 42 is connected and disposed through the toner bottle 41. The laser scanner 43 exposes the surface of the photosensitive drum 81, electrically charged by the charging roller 82, to light and thus electrostatic latent image is formed on the surface of the photosensitive drum 81.

The image forming unit 80 includes the four image forming unit is 80*y*, 80*m*, 80*c*, 80*k* for forming toner images of the four colors. Each image forming unit 80 includes the photosensitive drum 81 for forming the toner image, a charging roller 82, a developing device 20 and a cleaning blade 84. Further, the photosensitive drum 81, the charging roller 82, the developing device 20, the cleaning blade 84 and a developing sleeve 24 described later have the same constitution for the four colors of yellow (y), magenta (m), cyan (c), black (k), respectively, and are separately provided.

The photosensitive drum 81 includes a photosensitive layer formed on an outer peripheral surface of an aluminum cylinder so as to have a negative charge polarity, and is rotated in an arrow direction at a predetermined process speed (peripheral speed). The charging roller 82 contacts the surface of the photosensitive drum 81 and electrically charges the surface of the photosensitive drum 81 to, e.g., a uniform negative dark-portion potential. After the charging, at each of the respective surfaces of the photosensitive drums 81, an electrostatic image is formed on the basis of image information by the laser scanner 43. Each of the photosensitive drums 81 carries the formed electrostatic image and is circulated and moved, and the electrostatic image is developed with the toner by the developing device 20. Details of a structure of the developing device 20 will be described later.

The toner image obtained by developing the electrostatic image is primary-transferred onto the intermediary transfer belt 44*b* described later. The surface of the photosensitive drum 81 after the primary transfer is discharged by an unshown pre-exposure portion. The cleaning blade 84 is disposed in contact with the surface of the photosensitive drum 81 and removes a residual matter such as transfer residual toner remaining on the surface of the photosensitive drum 81 after the primary transfer.

The intermediary transfer unit 44 is disposed above the image forming units 80*y*, 80*m*, 80*c* and 80*k*. The intermediary transfer unit 44 includes a driving roller 44*a*, a plurality of primary transfer rollers 44*y*, 44*m*, 44*c* and 44*k*, and the intermediary transfer belt 44*b* wound around these rollers. The primary transfer rollers 44*y*, 44*m*, 44*c* and 44*k* are disposed opposed to the photosensitive drums 81, 81*m*, 81*c* and 81*k*, respectively, and are disposed in contact with the intermediary transfer belt 44*b*.

A positive-polarity transfer bias is applied to the intermediary transfer belt 44*b* through the primary transfer rollers 44*y*, 44*m*, 44*c* and 44*k*, whereby toner images having the negative polarity are superposedly transferred successively from the photosensitive drums 81*y*, 81*m*, 81*c* and 81*k* onto the intermediary transfer belt 44*b*. By this, the toner images obtained by developing the electrostatic images on the surfaces of the photosensitive drums 81*y*, 81*m*, 81*c* and 81*k* are transferred on the intermediary transfer 44*b*, and the intermediary transfer belt 44*b* moves.

The secondary transfer portion 45 includes a secondary transfer inner roller 45*a* and a secondary transfer outer roller 45*b*. By applying a positive-polarity secondary transfer bias to the secondary transfer outer roller 45*b*, the full-color image formed on the intermediary transfer belt 44*b* is transferred onto the sheet S. The fixing device 46 includes a fixing roller 46*a* and a pressing roller 46*a*. The sheet S is nipped and fed between the fixing roller 46*a* and the pressing roller 46*b*, so that the toner image transferred on the sheet S is pressed and heated and thus is fixed on the sheet S.

The sheet feeding portion 50 feeds the sheet S, fed from the sheet feeding portion 30, from the image forming portion 40 to the sheet discharge portion 11. The sheet discharge portion 11 is a face-down tray, and the sheet S discharged through the discharge opening 10*a* in an arrow X direction is stacked on the sheet discharge portion 11.

The controller 12 is constituted by a computer and, e.g., includes a CPU, an ROM for storing a program for controlling respective portions, an RAM for temporarily storing data, and an input-and-output circuit for inputting and outputting signals relative to an external device. The CPU is a microprocessor for effecting entire control of the image forming apparatus 1 and is a principal part of a system controller. The CPU is connected via the input-and-output circuit with each of the sheet feeding portion 30, the image forming portion 40, the sheet feeding portion 50, and an operating portion, and transfers signals with the respective portions and controls operations of the respective portions.

Next, an image forming operation in the image forming apparatus 1 constituted as described above will be described.

When the image forming operation is started, first, the photosensitive drum 81 is rotated, and the surface thereof is electrically charged by the charging roller 82. Then, the laser scanner 43 emits, on the basis of image information, a laser beam toward the surface of the photosensitive drum 81, so that the electrostatic latent image is formed on the surface of the photosensitive drum 81. The toner is deposited on the electrostatic latent image, so that the electrostatic latent image is developed (visualize) into a toner image, and then the toner image is transferred onto the intermediary transfer belt 44*b*.

On the other hand, in parallel to such a toner image forming operation, the feeding roller 32 is rotated and feeds the uppermost sheets S in the sheet cassette 31 while separating the sheets S. Then, each of the sheets S is fed to the secondary transfer portion 45 by being timed to the toner image on the intermediary transfer belt 44*b*. Then, the toner image is transferred from the intermediary transfer belt 44*b* onto the sheet S, and the sheet S is fed into the fixing device 46, in which the unfixed toner image is heated and pressed, thus is fixed on the surface of the sheet S. The sheet S is discharged through the discharge opening 10*a* and is stacked on the sheet discharge portion 11.

Figure 2:
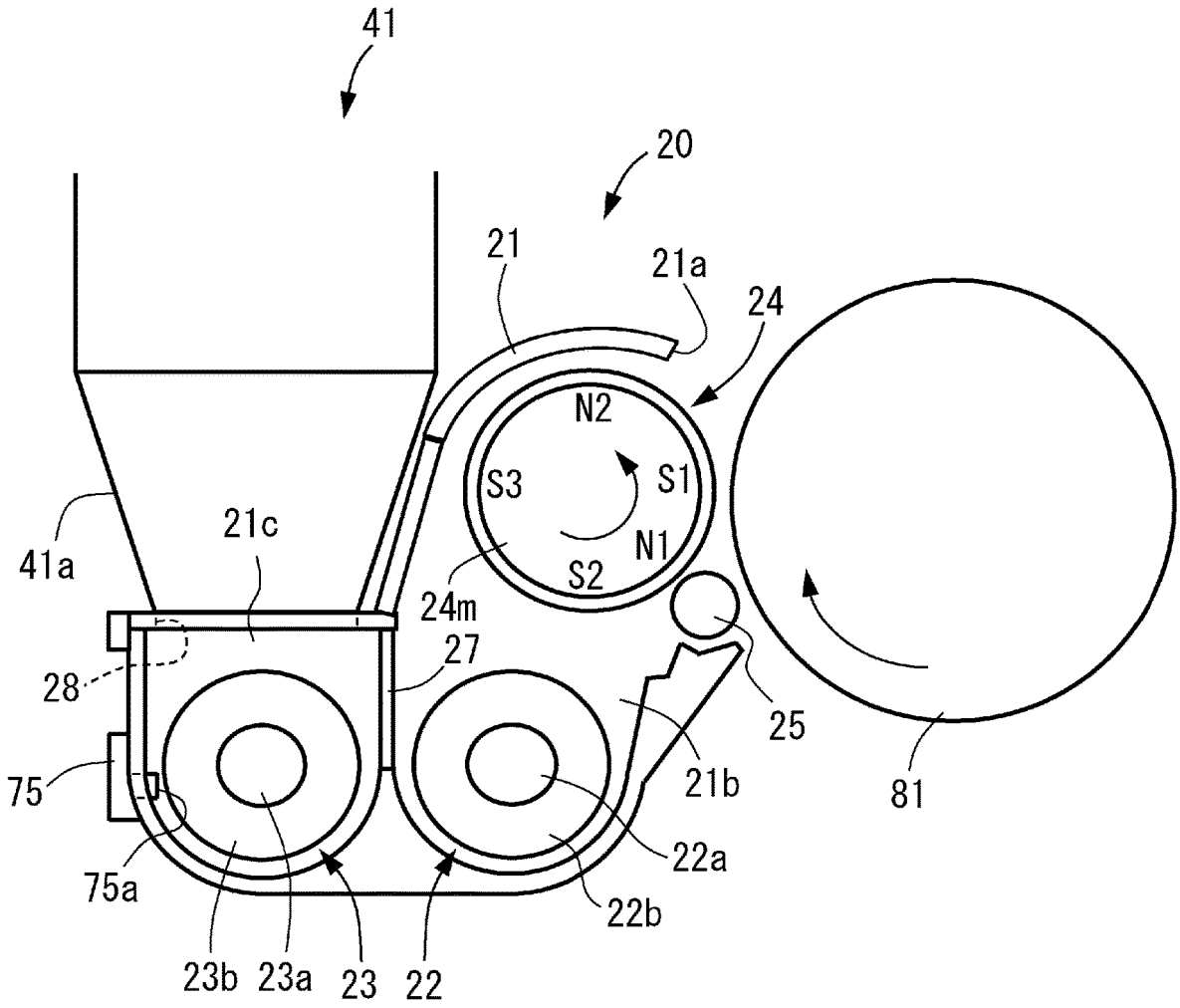
FIG. 2 is a sectional view showing a schematic structure of a developing device according to the embodiment.
Figure 3:
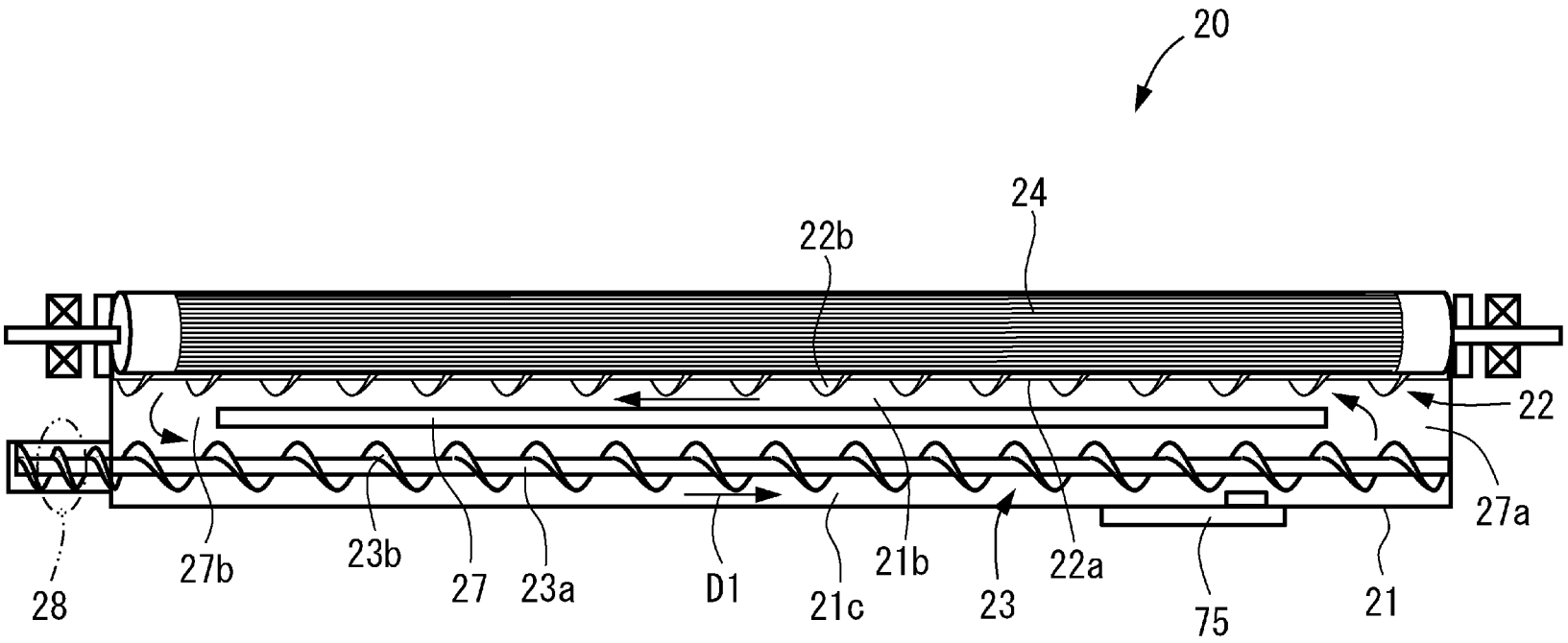
FIG. 3 is a plan view showing a circulating path of the developing device according to the embodiment.

Next, the developing device 20 will be specifically described with reference to FIGS. 2 and 3. The developing device 20 includes a developing (developer) container 21 accommodating the developer, a first feeding screw 22 and a second feeding screw 23, the developing sleeve 24, a regulating member (developer regulating member) 25, and a content detecting sensor 75. The developing device 20 not only accommodates the developer but also develops the electrostatic latent image on the photosensitive drum 81. The developing container 21 is provided with an opening 21*a* where the developing sleeve 24 is exposed at a position opposing the photosensitive drum 81.

The developing container 21 includes a partition wall 27 extending in a longitudinal direction substantially at a central portion. The developing container 21 is partitioned by the partition wall 27 into a developing chamber 21*b* and a stirring chamber 21*c* with respect to a horizontal direction. The developer is accommodated in the developing chamber 21*b* and the stirring chamber 21*c*. In the developing chamber 21*b*, the developer is fed to the developing sleeve 24. The stirring chamber 21*c* communicates with the developing chamber 21*b*, and the developer is collected from the developing sleeve 24 and is stirred. The partition wall 27 between the developing chamber 21*b* and the stirring chamber 21*c* is provided with two communicating portions 27*a* and 27*b* for establishing communication of the developing chamber 21*b* and the stirring chamber 21*c* with each other at opposite end portions. Incidentally, in the developing device 20 in this embodiment, the developing chamber 21*b* and the stirring chamber 21*c* are arranged in a horizontal direction, but the present invention is not limited thereto, and the developing chamber and the stirring chamber may also be disposed vertically or a developing device in another form may also be used.

The first feeding screw 22 is disposed in the developing chamber 21*b* along an axial direction of the developing sleeve 24 and in substantially parallel with the developing sleeve 24, and feeds the developer in the developing chamber 21*b* while stirring the developer. The first feeding screw 22 includes a shaft portion 22*a* which is provided rotatably in the developer container 21 and which has a magnetic property, and includes a helical feeding blade 22*b*, which rotates integrally with the shaft portion 22*a*, for feeding the developer in the developer container in a feeding direction D1 by rotation thereof.

The second feeding screw 23 is disposed in the stirring chamber 21*c* in substantially parallel with a shaft of the first feeding screw 22, and feeds the developer in the stirring chamber 21*c* in a direction opposite to the feeding direction of the first feeding screw 22. The second feeding screw 23 includes a shaft portion 23*a* which is provided rotatably in the developer container 21 and which has a magnetic property, and includes a helical feeding blade 23*b*, which rotates integrally with the shaft portion 23*a*, for feeding the developer in the developer container 21 in a feeding direction D1 by rotation thereof. The developing chamber 21*b* and the stirring chamber 21*c* constitute a circulation path of the developer along which the developer is fed while being stirred. The toner is triboelectrically charged to the negative polarity through sliding with the carrier by being stirred by the respective screws 22 and 23.

In the stirring chamber 21*c*, at an end portion on an upstream side with respect to the developer feeding direction D1, a supply opening (port) 28 which opens upward is formed, and a hopper 41*a* of the toner bottle 41 is connected to the supply opening 28. The hopper 41*a* accommodates a two-component supply developer (toner/supply developer=100% to 80% in general) in which the toner and the carrier are mixed with each other. The toner supplied from the toner bottle 41 is supplied to the stirring chamber 21*c* through the hopper 41*a* and the supply opening 28. The hopper 41*a* incorporates an unshown supplying screw at a lower portion and is capable of supplying the developer from the supplying screw to the supply opening 28.

The developing sleeve 24 carries the developer including the non-magnetic toner and the magnetic carrier and rotationally feeds the developer to a developing region opposing the photosensitive drum 81. The developing sleeve 20 is constituted by, for example, a non-magnetic material such as aluminum or non-magnetic stainless steel, and is formed in a diameter of 20 mm in this embodiment by aluminum. Inside the developing sleeve 24, a roller-shaped magnet roller (magnetic field generating means) 24*m* is fixedly provided to the developing container 21 in a non-rotatable state. The magnet roller 24*m* includes a plurality of a magnetic poles N1, S1, N2, S3 and S2 at a surface thereof. Of these magnetic poles, the magnetic pole N1 is a regulating magnetic pole N1, and the magnetic pole S1 is a developing magnetic pole S1. That is, the magnet roller 24*m* is provided inside the developing sleeve 24 and includes the plurality of magnetic poles including the regulating magnetic pole N1 disposed opposed to the regulating member 25. Incidentally, the regulating magnetic pole N1 will be described later.

The developer in the developing device 20 is carried on the developing sleeve 24 by the magnet roller 24*m*. Thereafter, the developer on the developing sleeve 24 is subjected to regulation of a layer thickness thereof, and is fed to the developing region opposing the photosensitive drum 81 by rotation of the developing sleeve 24. The developer on the developing sleeve 24 is erected in the developing region and forms the magnetic chains. The magnetic chains are contacted to the photosensitive drum 81, whereby the toner is supplied to the photosensitive drum 81 and thus the electrostatic latent image on the photosensitive drum 81 is developed as the toner image.

The regulating member 25 is formed using a cylindrical magnetic steel, of 6 mm in diameter, such as an SUM material (easy-cutting (machining) steel). The regulating member 25 is disposed opposed to the developing sleeve 24 and has a magnetic property. The regulating member 25 is curved in a direction of projecting toward the developing sleeve 24 and regulates an amount of the developer carried on the developing sleeve 24 with respect to the rotational direction of the developing sleeve 24.

The content (concentration) detecting sensor 75 is attached to an outside of the developer container 21 and is disposed so that a detecting surface 75*a* is exposed toward an inside of the developer container 21 through a through-hole formed in a side wall of the stirring chamber 21*c* of the developer container 21. The content sensor 75 is connected to the controller 12 and detects a content (concentration) of the developer fed in the stirring chamber 21*c* of the developer container 21, and then sends an electric signal to the controller 12. The controller 12 enables execution of automatic toner replenishing control (ATR) by utilizing the content detecting sensor 75, so that the toner supplied through the supply opening 28 and the developer in the stirring chamber 21*c* are stirred and fed by the feeding screw 23 and thus the toner content is uniformized.

Figure 4:
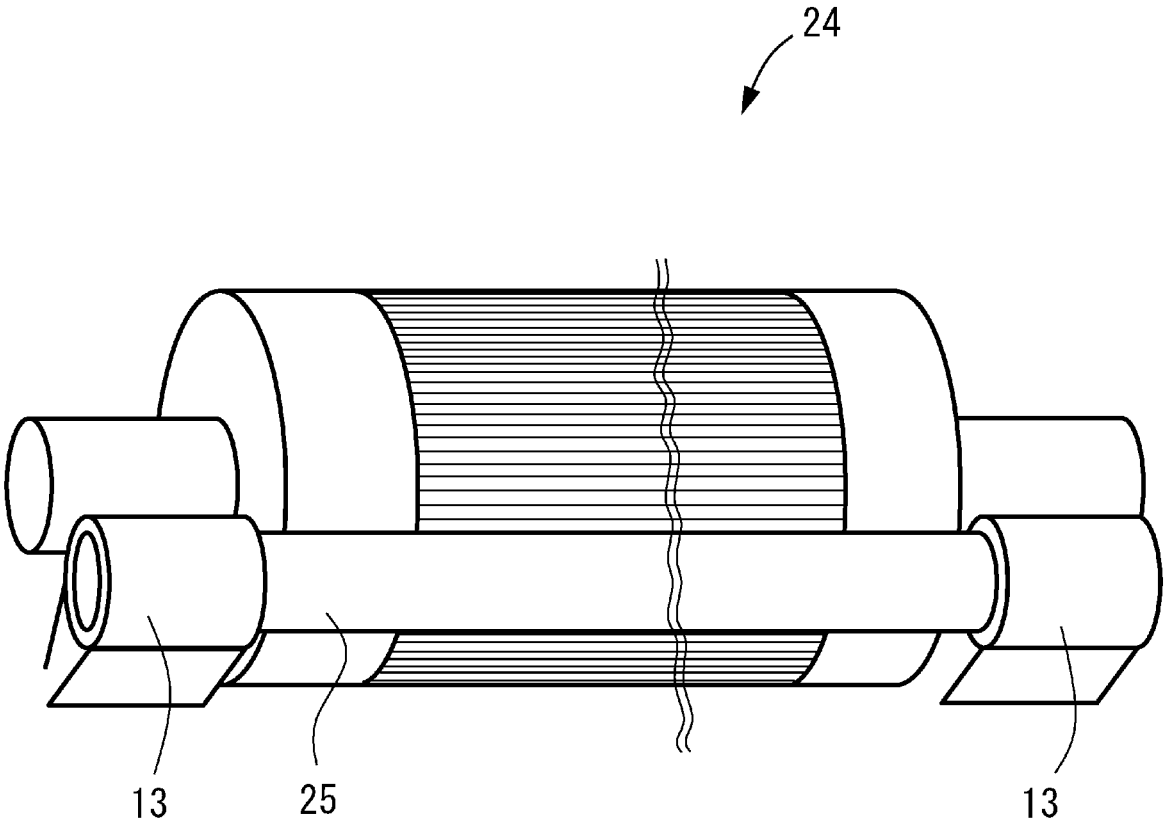
FIG. 4 is a perspective view showing an arrangement of a regulating member relative to a developing sleeve of the developing device according to the embodiment.

Next, a supporting structure of the regulating member 25 relative to the developing sleeve 24 will be described on the basis of FIG. 4. The regulating member 25 is disposed in parallel to the developing sleeve 24 and is supported at opposite end portions thereof by a cylindrical supporting member 13 provided in the developer container 21, and is fixed to the developer container 21 with a certain gap (interval) with the surface of the developing sleeve 24. However, the supporting member 13 is not limited to the supporting member fixed to the developer container 21 but may also have a constitution in which the supporting member is not is fixed to the developer container 21 and is provided so that a range of the gap with the developing sleeve 24 is adjustable.

The supporting member provided outside an image forming region is fixed by light press-fitting therein the cylindrical bar which is the regulating member 25. A press-fitting amount of the light press-fitting at this time, i.e., a difference between a diameter of the cylinder of the regulating member 25 and an inner diameter of the cylinder of the supporting member 13 is 20-50 μm Incidentally, when the press-fitting amount is 50 μm or more, it causes a distortion of the container and flexure of the cylindrical bar, and therefore, is undesirable as a constitution for forming the SB gap requiring accuracy. Further, when the press-fitting amount is 20 μm or less, it is undesirable since there is a liability that positional deviation or the like occurs due to vibration generated by transportation or the like and there is a liability that a sufficient supporting force cannot be obtained against flexure by a distribution pressure and by urging with a urethane sheet described later.

Further, in addition thereto, in order to suppress the flexure to a minimum level, a supporting width of opposite ends of the cylindrical bar may desirably be 5 mm or more, preferably be 8 mm or more, on one side. In the case of using the regulating member 25, a portion other than the supporting member 13 is provided in non-contact with the developer container 21, and therefore, a gap generates as regards a portion, close to the developing sleeve 21, except for the opposite end portions. For that reason, it is preferable that leakage of the developer during transportation and during normal operation is prevented by mounting a urethane sheet (for example, Nippalay C, manufactured by NKH SPRINGS Co., Ltd.) which is an elastic member in this gap.

Next, a positional relationship between the regulating member 25 and the magnet roller 24*m* will be described. The magnet roller 24*m* has the regulating magnetic pole N1 for coating the developer layer in a thin layer, at a position opposing the regulating member 25, and a height of the magnetic chains is regulated at a position where the magnetic chains are formed by the regulating magnetic pole N1, so that an amount of the developer passing through the position is controlled.

In a constitution in which a flat plate-like developer regulating member which has been conventionally used frequently in general, the regulating magnetic pole N1 is disposed in many instances at a position opposing a closest position of the regulating member or a position deviated 3-5 degrees upstream or downstream of the closest position with respect to the rotational direction of the developing sleeve 24. Then, the developer regulating member is fixed to the developer container 21 directly or via a metal plate, with screws or the like, for supporting the developer regulating member. For that reason, the developer regulating member is needed to have an area in which the developer regulating member is fastened by screws and thus is required to have a size to some extent. Further, as a technique for stabilizing the SB gap, it has been known a constitution in which magnetic chains are formed by concentrating magnetic fluxes at a free end of the developer regulating member with use of a flat plate-like developer regulating member having a magnetic property. However, when the SB gap is deviated from a designed center value due to a tolerance of component parts such as the magnet roller 24*m*, the developer container 21, the developer regulating member or the like, an assembling tolerance, or the like, a degree of inclination or the like of magnetic lines of force changes for each of developing devices, so that M/S is not stabilized in some instances.

Further, in the case of the constitution of using the cylindrical regulating member 25 which conventionally exists, a nip width formed by the SB gap to the opposing regulating magnetic pole N1 becomes broad. However, a magnetic flux line extending toward an arcuate surface of the cylindrical regulating member 25 and a magnetic flux density distribution become stronger toward a nip center side, but the magnetic flux density becomes weaker toward an outside of the nip. For this reason, the magnetic flux density becomes weak at a portion where the magnetic flux density and the magnetic chains at the closest position to the regulating member 25 are separated (spaced) from the regulating member 25, so that a state of the magnetic chains becomes unstable. Further, a positional relationship between the magnetic flux density distribution of the regulating magnetic pole N1 and the arcuate surface of the regulating member 25 is deviated by the tolerances or the like of the respective members, so that stability of magnetic chain regulation lowers.

Figure 5:
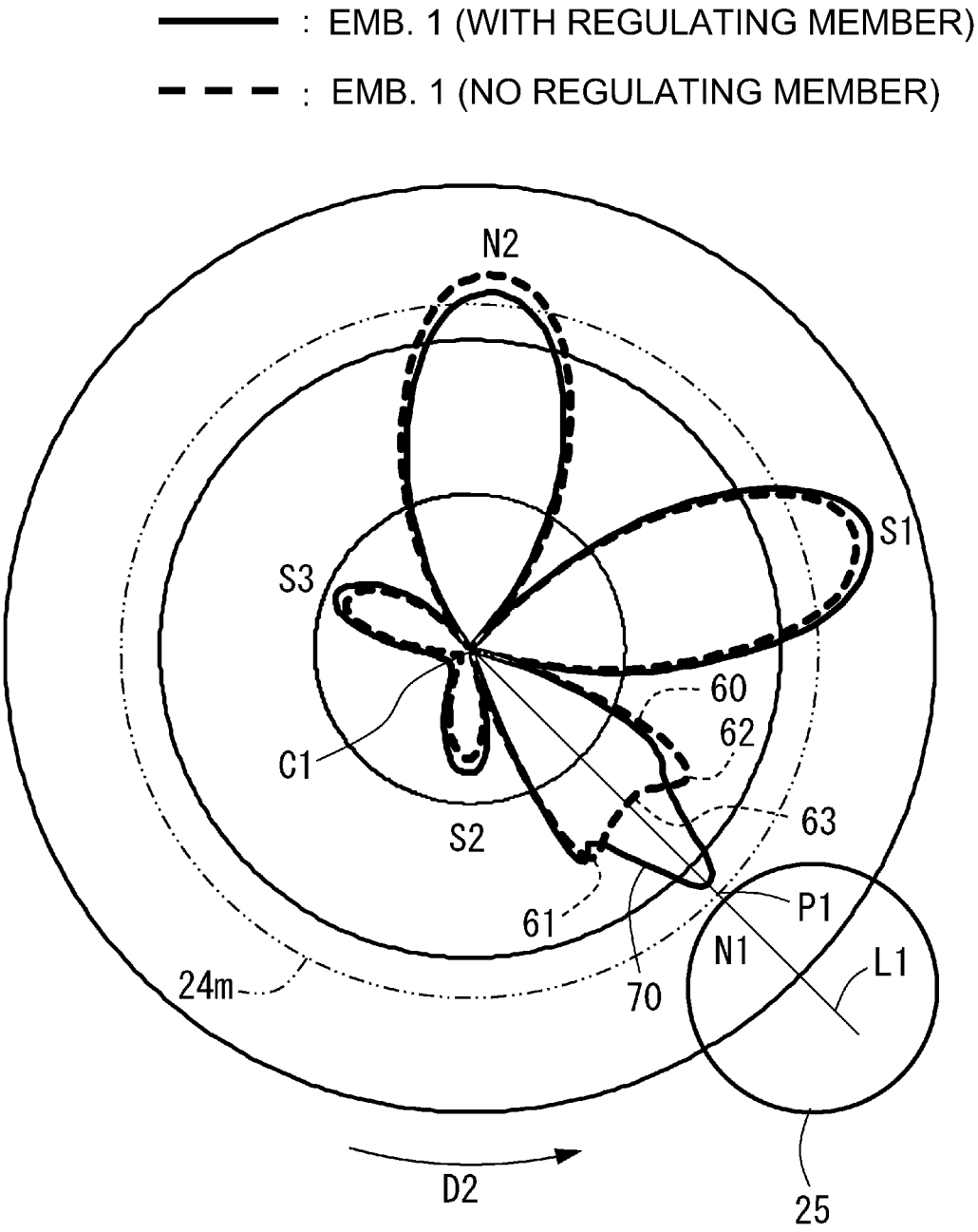
FIG. 5 is a graph showing a magnetic flux distribution of a magnet roller according to Embodiment 1.

On the other hand, in this embodiment, the cylindrical regulating member 25 is used, but the magnetic flux density distribution of the regulating magnetic pole N1 opposing the regulating member 25 is a characteristic distribution. As shown in FIG. 5, a magnetic flux density distribution 60 of the regulating magnetic pole N1 in the case where the regulating member 25 is not provided includes a first local maximum portion 61, a second local maximum portion 62 and a local minimum portion 63 positioned between the first local maximum portion 61 and the second local maximum portion 62. The first local maximum portion 61 is positioned on a side, with respect to a rotational direction D2, of a closest position P1 of the magnet roller 24*m* to the regulating member 25. The second local maximum portion 62 is positioned on a side downstream of the closest position P1 with respect to the rotational direction D2. The local minimum portion 63 is positioned on a rectilinear line L1 (on a rectilinear line) connecting the closest position P1 and a center position C1 of the magnet roller 24*m*. That is, the magnetic flux density distribution 60 formed by the regulating magnetic pole N1 has a recessed shape such that a normal direction magnetic flux density Br to the closest position P1 between the regulating member 25 and the developing sleeve 24 is low. Further, a constitution in which the normal direction magnetic flux density Br of the regulating magnetic pole N1 becomes larger as an arcuate surface formed by the regulating member 25 on sides upstream and downstream of the closest position P1 with respect to the rotational direction D2 is spaced from the surface of the developing sleeve is employed.

In this embodiment, it is preferable that the magnetic flux densities of the first local maximum portion 61 and the second local maximum portion 62 are the same and that the magnetic flux density of the local minimum portion 63 is set so as to be smaller than the magnetic flux densities of the first local maximum portion 61 and the second local maximum portion 62 by 3 mT or more. When a difference ΔBr in magnetic flux density between the local minimum portion 63 and the first local maximum portion 61 and between the local minimum portion 63 and the second local maximum portion 62 of the regulating magnetic pole N1 is less than 3 mT, a top portion of the magnetic flux density distribution 60 is close to a flat shape (see a flat portion 261 in Comparison Example 2 of FIG. 8). In this case, in a magnetic flux density distribution of the regulating magnetic pole N1 in the case where the regulating member 25 is provided, a magnetic flux density distribution of the gap between the developing sleeve 24 and the regulating member 25 has large inclination, so that a fluctuation in M/S on the developing sleeve 24 becomes large and is unpreferred. Further, when an outer diameter of the developing sleeve 24 is R1 and an outer diameter of the regulating member 25 is r1, a fluctuation in M/S against a fluctuation due to tolerances or the like of the regulating member 25 and the regulating magnetic pole n1 can be suppressed when a half-width W of the regulating magnetic pole N1 is $W \geq 360 \times \pi \times r1/R1$, so that a desirable constitution is provided. Incidentally, magnetic flux densities and dimensions of the respective portions described above are an example, and the present invention is not limited thereto as a matter of course.

A magnetic flux density distribution 70 in the case where the developing device 20 is assembled and the regulating member 25 is provided opposed to the developing sleeve 24 will be described. The magnetic flux density distribution 70 of the regulating magnetic pole N1 in the case where the regulating member 25 is provided is not concentrated extremely compared with the case where the local minimum portion 63 is not provided (see FIGS. 7 and 8). By this, the magnetic chains are formed in the SB gap along magnetic lines of force in a stable state.

As described above, according to the developing device 20 of this embodiment, the magnetic flux density distribution 60 of the regulating magnetic pole N1 includes the first local maximum portion 61, the second local maximum portion 62 and the local minimum portion 63 positioned between these local maximum portions 61 and 62. For this reason, in this magnetic flux density distribution 60, a magnetic flux extending toward the regulating member 25 having the magnetic property gently changes compared with the case of including only a single maximum value. By this, even when the SB gap is fluctuated by the component part tolerance, the tolerance during the assembling, and the like, stabilization of the developer weight per unit area of the developing sleeve 24 can be realized.

Further, according to the developing device 20 of this embodiment, the local minimum portion 63 is positioned on the rectilinear line L1 connecting the closest position P1 and the center position C1 of the magnet roller 24. For this reason, the magnetic flux density distribution 60 is a uniform distribution on sides upstream and downstream of the closest position P1, so that the magnetic flux extending toward the regulating member 25 gently changes as to both of upstream and downstream sides compared with the case where the local minimum portion 63 is positioned apart from the rectilinear line L1. By this, even when the SB gap is fluctuated by the tolerances or the like, stabilization of the developer weight per unit area of the developing sleeve 24 can be realized. Incidentally, in this embodiment, the local minimum portion 63 is positioned on the rectilinear line L1, but the present invention is not limited to that the local minimum portion 63 and the rectilinear line L1 are positioned at the same position, and these may also be positioned close to each other or may also be positioned separately from each other.

In the developing device 20 in the above-described embodiment, the case where the magnetic flux densities of the first local maximum portion 61 and the second local maximum portion 62 are the same was described, but the present invention is not limited thereto. For example, a magnetic flux density Br1 of the first local maximum portion 61 may also be set so as to be smaller than a magnetic flux density Br2 of the second local maximum portion 62 (Br1<Br2). In this case, an abrupt change of the magnetic flux density distribution in the SB gap becomes small, so that a change in magnetic force exerted on the developer entering the SB gap is decreased. By this, M/S non-uniformity of the developing sleeve 24 due to fluctuations such as deflection of the SB gap, flexure of the regulating member 25 and the like is reduced, so that a stable coating amount can be obtained.

Further, also in this case, each of the magnetic flux densities of the first local maximum portion 61 and the second local maximum portion 62 may preferably be larger than the magnetic flux density of the local minimum portion 63 by 3 mT or more. Further, the magnetic flux density Br1 of the first local maximum portion 61 may preferably be smaller than the magnetic flux density Br2 of the second local maximum portion 62 by 1 mT or more. By this, the magnetic force generating in the SB gap further become smaller than that in the case where the magnetic flux densities of the first local maximum portion 61 and the second local maximum portion 62 are the same, so that a magnetic flux density change amount in the SB gap can be further made small. For this reason, a change in force exerted on the magnetic chains becomes small in an entire region of the SB gap, so that the M/S change amount of the developing sleeve 24 against the SB gap fluctuation can be further decreased (see FIG. 9).

In the developing device 20 of the above-described embodiment, the case where the local minimum portion 63 is provided at only one position between the first local maximum portion 61 and the second local maximum portion 62 was described, but the present invention is not limited thereto. For example, the local minimum portion 63 may also be provided at two or more positions between the first local maximum portion 61 and the second local maximum portion 62.

Embodiments

Using the developing device 20 of the above-described embodiment, a relationship between an SB gap length and M/S was measured as to each of the cases where a magnetization pattern of the magnet roller 24*m* is changed.

Embodiment 1

Figure 9:
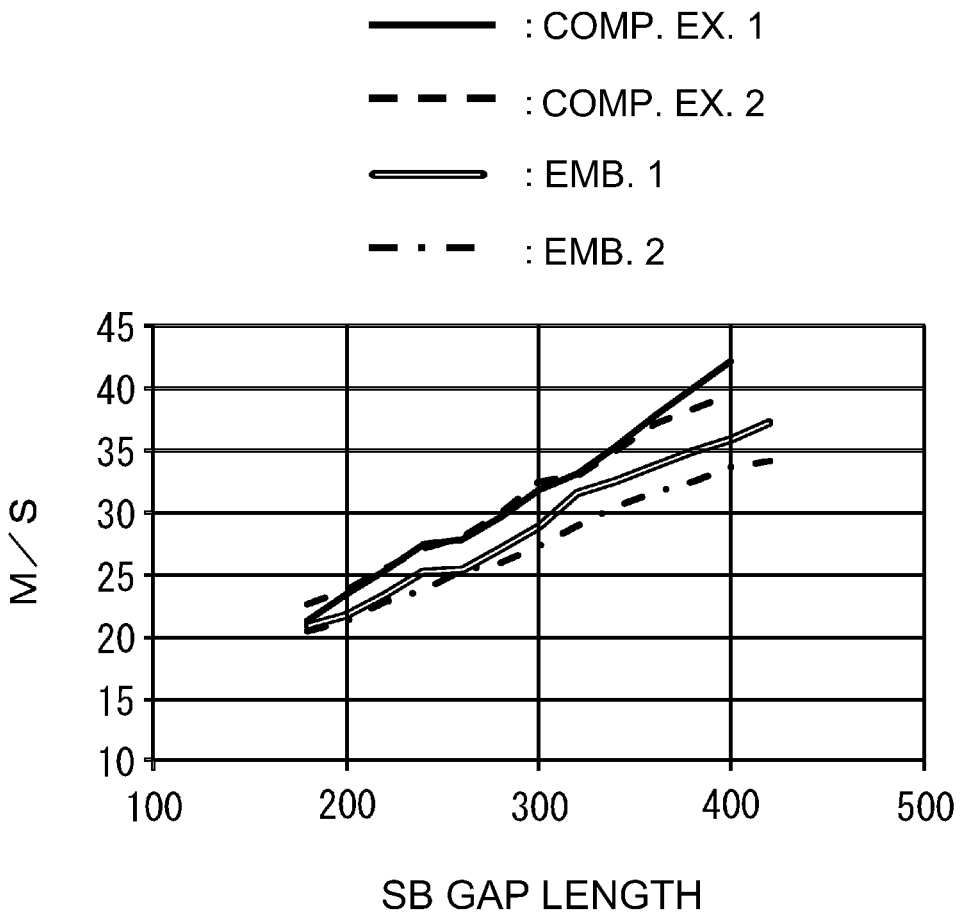
FIG. 9 is a graph showing a relationship between an SB gap length and M/S according to the embodiment.

As shown in FIG. 5, in the magnetic flux density distribution 60 of the regulating magnetic pole N1 when the regulating member 25 is not provided for the magnet roller 24*m* of the developing device 20 of the embodiment, normal direction magnetic flux densities of the local maximum portions 61 and 62 were 65 mT, and a normal direction magnetic flux density of the local minimum portion 63 was 60 mT. A half-width at the time was 46 degrees. As a result, in the magnetic flux density distribution 70 of the regulating magnetic pole N1 when the regulating member 25 is provided, relative to a distribution of magnetic lines of force in Comparison Example 1, the magnetic flux density is not concentrated extremely and the magnetic chains were formed in the SB gap along the magnetic lines of force in a stable state. For that reason, compared with the Comparison Example, a change in magnetic force in the SB gap is small and stable regulation can be carried out, and therefore, as shown in FIG. 9, in the fluctuation in M/S of the developing sleeve 24, latitude was broadened relative to the Comparison Example. Accordingly, according to the developing device 20 of this embodiment, even when the SB gap is fluctuated by the component part tolerance, the tolerance during the assembly and the like, it was confirmed that the developer weight per unit area of the developing sleeve 24 can be stabilized.

Embodiment 2

Figure 6:
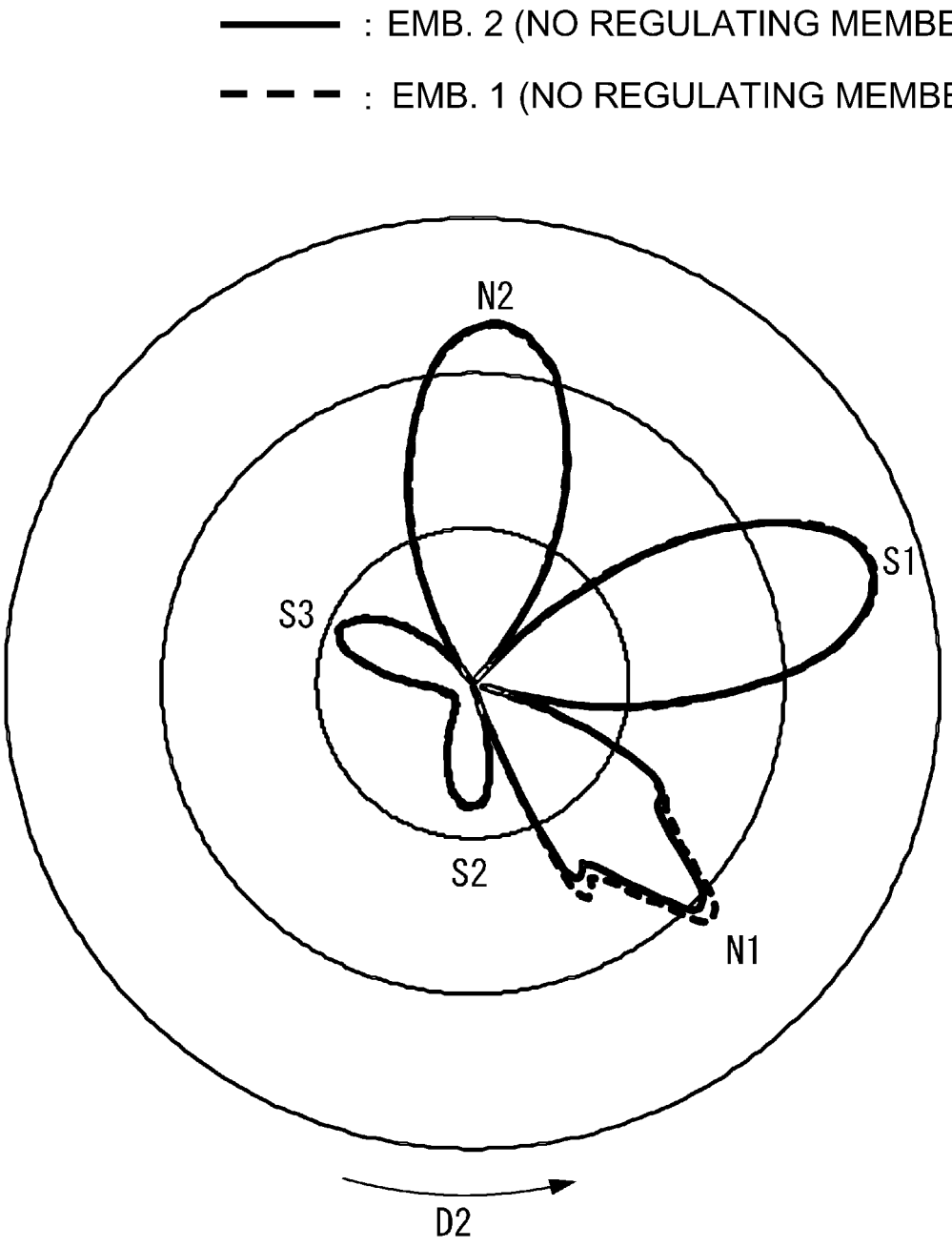
FIG. 6 is a graph showing a magnetic flux distribution of a magnet roller according to Embodiment 2.

As shown in FIG. 6, in the magnetic flux density distribution 60 of the regulating magnetic pole N1 when the regulating member 25 is not provided for the magnet roller 24*m* of the developing device 20 of the embodiment, the magnetic flux density Br1 of the first local maximum portion 61 was 65 mT, the magnetic flux density Br2 of the second local maximum portion 62 was 69 mT, and a normal direction magnetic flux density of the local minimum portion 63 was 60 mT. A half-width at the time was 46 degrees. As a result, the magnetic lines of force generating at the SB gap portion was such that a peak value is lower than that in the case of Embodiment 1, so that a magnetic flux density change amount in the SB gap becomes small, and a change in force exerted on the magnetic chains became small in an entire region of the SB gap. For that reason, as shown in FIG. 9, the M/S change amount on the developing sleeve 24 against the SB gap fluctuation was able to be further decreased than that in Embodiment 1. Accordingly, according to the developing device 20 of this embodiment, even when the SB gap is fluctuated by the component part tolerance, the tolerance during the assembly and the like, it was confirmed that the developer weight per unit area of the developing sleeve 24 can be stabilized.

Comparison Example 1

Figure 7:
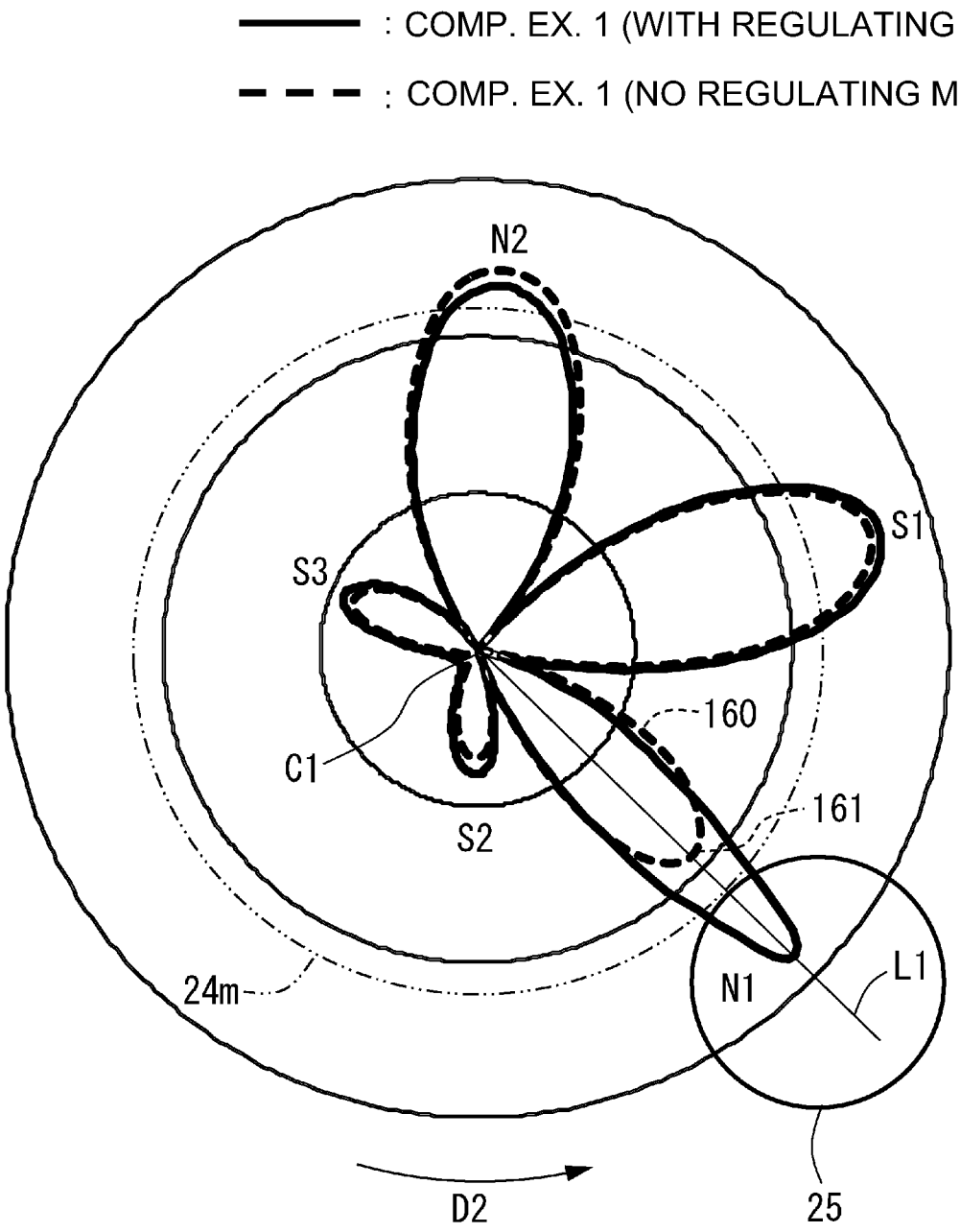
FIG. 7 is a graph showing a magnetic flux distribution of a magnet roller according to Comparison Example 1.

As shown in FIG. 7, on the magnet roller 24*m* of the developing device 20 of the embodiment, a regulating magnetic pole N1 of an ordinarily shaped magnetic flux density distribution 160 including only a single local maximum portion 161 (normal direction magnetic flux density: 65 mT) without including the local minimum portion was magnetized. The magnetic chains of the thin layer formed by the regulating member 24 are formed along magnetic lines of force between the surface of the magnetic regulating member 25 and the developing sleeve 24 with the regulating magnetic pole N1, and a length of the magnetic chains is determined by a magnitude of the magnetic flux density. By using the magnetic regulating member 25, directivity is imparted to the magnetic lines of force, and therefore, magnetic chain formation easily becomes stable. However, in the case where the magnetic regulating member 25 is used, the magnetic lines of force in the SB gap are formed in a concentrated manner compared with the case of no magnetic material, and therefore, there is a tendency that the magnetic flux density is large and the magnetic lines of force are formed in a somewhat narrow state. For that reason, there is a liability that the developer is excessively supplied in the SB gap and thus the magnetic chains are not stably formed in such a manner that the length of the magnetic chains formed after the supplied developer passes through the SB gap is elongated or the like.

As shown in FIG. 7, the magnetic flux density abruptly increases at the closest position P1 to the regulating member 25, so that a change amount of a magnetic flux density distribution 160 by the magnetic property of the regulating member 25 became large compared with Embodiments 1 and 2. For that reason, as shown in FIG. 9, in the fluctuation in M/S of the developing sleeve 24, latitude remarkably narrowed relative to Embodiments 1 and 2.

Comparison Example 2

Figure 8:
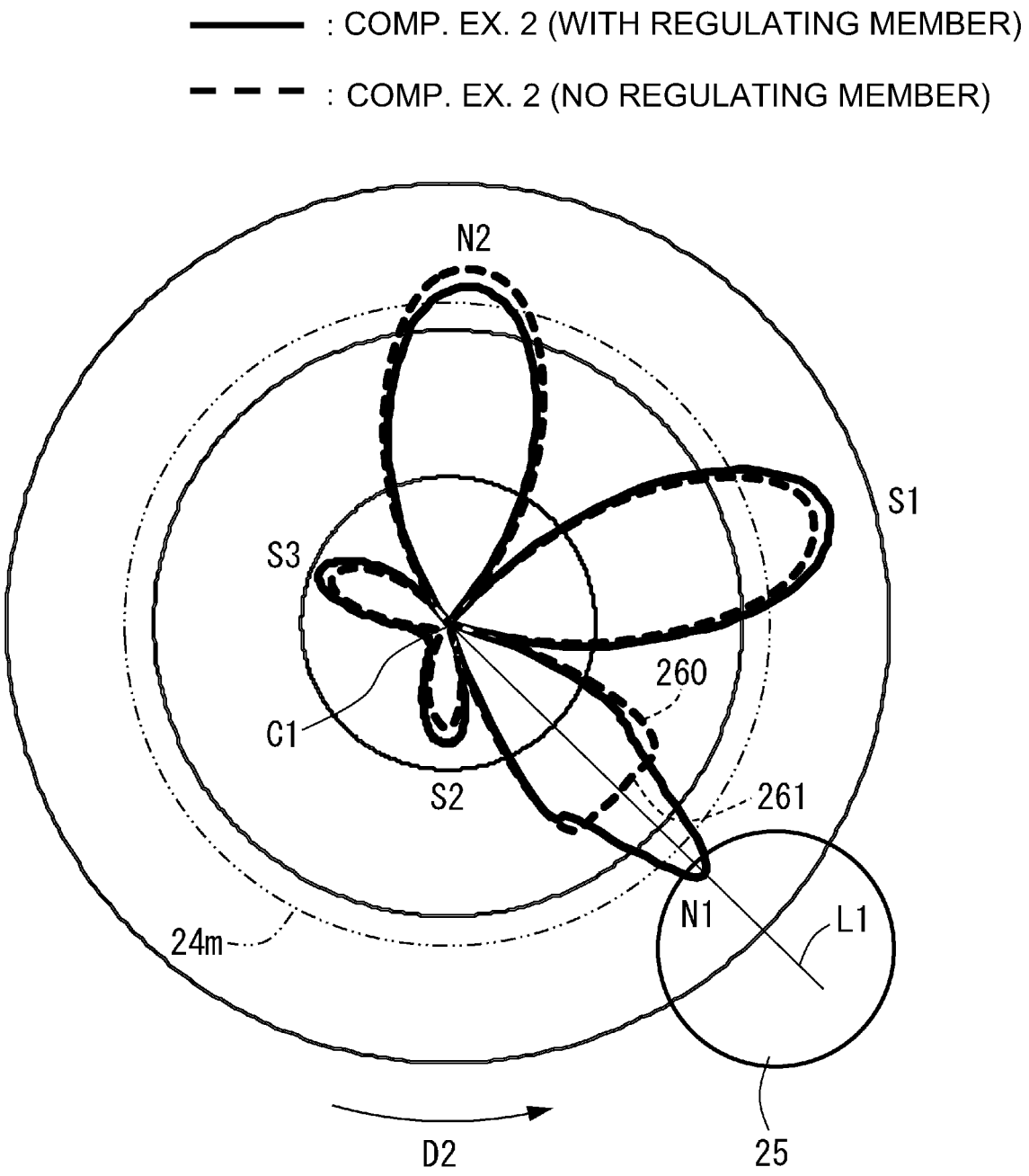
FIG. 8 is a graph showing a magnetic flux distribution of a magnet roller according to Comparison Example 2.

As shown in FIG. 8, on the magnet roller 24*m* of the developing device 20 of the embodiment, a regulating magnetic pole N1, having a normal direction magnetic flux density of 60 mT, of a magnetic flux density distribution 260 including a flat portion 261 without including the local minimum portion and the local maximum portions was magnetized. The magnetic flux density relatively abruptly increases at the closest position P1 to the regulating member 25, so that a change amount of a magnetic flux density distribution 260 by the magnetic property of the regulating member 25 became large compared with Embodiments 1 and 2. For that reason, as shown in FIG. 9, in the fluctuation in M/S of the developing sleeve 24, latitude remarkably narrowed relative to Embodiments 1 and 2.

INDUSTRIAL APPLICABILITY

According to the present invention, there is provided a developing device capable of a high image quality and high-quality development.

EXPLANATION OF SYMBOLS

20, 20*c*, 20*k*, 20*m*, 20*y* . . . developing device, 24 . . . developing sleeve, 24*m* . . . magnet roller (magnetic field generating means), 25 . . . regulating member (developer regulating member), 60 . . . magnetic flux density distribution of regulating magnetic pole, 61 . . . first local maximum portion, 62 . . . second local maximum portion, 63 . . . local minimum portion, C1 center position, D1 . . . rotational direction, L1 . . . rectilinear line, N1 . . . regulating magnetic pole, P1 . . . closest position.

The invention claimed is:

1. A developing device comprising:

a rotatable developer carrying member for carrying a developer including non-magnetic toner and a magnetic carrier;

a developer regulating member, having a magnetic property, for regulating an amount of the developer on said developer carrying member;

a supporting portion for supporting opposite ends of said developer regulating member; and a cylindrical magnetic field generating member which is provided inside said developer carrying member and which has a plurality of magnetic poles including a regulating magnetic pole provided opposed to said developer regulating member, wherein a magnetic flux distribution provided by said regulating magnetic pole includes a first local maximum portion on a side upstream, with respect to a rotational direction of said developer carrying member, of a closest position between said magnetic field generating member and said developer regulating member, a second local maximum portion on a side downstream of the closest position with respect to the rotational direction, and a local minimum portion at a position between said first local maximum portion and said second local maximum portion, wherein as seen from a rotational axis direction of said developer carrying member, a rectilinear line connecting the closest position between said magnetic field generating member and said developer regulating member and a center of said magnetic field generating member is positioned between the first local maximum portion and the second local maximum portion with respect to the rotational direction, and wherein a cross-sectional shape of said developer regulating member as seen from a rotational axis direction of said developer carrying member is a circular shape.

2. A developing device according to claim 1, wherein a magnetic flux density of said first local maximum portion is smaller than a magnetic flux density of said second local maximum portion.

3. A developing device according to claim 2, wherein the magnetic flux density of said first local maximum portion is smaller than the magnetic flux density of said second local maximum portion by 1 mT or more.

4. A developing device according to claim 1, wherein a magnetic flux density of said local minimum portion is smaller than a smaller one of said first local maximum portion and second local maximum portion by 3 mT or more.

* * * * *